US011203059B2

(12) United States Patent
Cho et al.

(10) Patent No.: US 11,203,059 B2
(45) Date of Patent: Dec. 21, 2021

(54) MOLTEN MATERIAL TREATMENT APPARATUS

(71) Applicant: POSCO, Pohang-si (KR)

(72) Inventors: Hyun Jin Cho, Pohang-si (KR); Ju Han Choi, Pohang-si (KR); Sang Woo Han, Pohang-si (KR); Tae In Chung, Pohang-si (KR); Jang Hoon Kim, Pohang-si (KR)

(73) Assignee: POSCO, Pohang-si (KR)

( * ) Notice: Subject to any disclaimer, the term of this patent is extended or adjusted under 35 U.S.C. 154(b) by 142 days.

(21) Appl. No.: 16/630,982

(22) PCT Filed: Jul. 12, 2018

(86) PCT No.: PCT/KR2018/007911
§ 371 (c)(1),
(2) Date: Jan. 14, 2020

(87) PCT Pub. No.: WO2019/013568
PCT Pub. Date: Jan. 17, 2019

(65) Prior Publication Data

US 2020/0222974 A1 Jul. 16, 2020

(30) Foreign Application Priority Data

Jul. 14, 2017 (KR) ..... 10-2017-0089782

(51) Int. Cl.
*B22D 11/117* (2006.01)
*B22D 11/118* (2006.01)
(Continued)

(52) U.S. Cl.
CPC ..... *B22D 11/118* (2013.01); *B22D 1/002* (2013.01); *B22D 11/117* (2013.01); *B22D 41/00* (2013.01)

(58) Field of Classification Search
CPC ..... B22D 1/002; B22D 1/005; B22D 11/103; B22D 11/117; B22D 11/118; B22D 41/00; B22D 41/08
See application file for complete search history.

(56) References Cited

U.S. PATENT DOCUMENTS 4,671,499 A * 6/1987 Ishiyama ..... B22D 11/118 266/236

FOREIGN PATENT DOCUMENTS

CN 1172446 2/1998
CN 102728827 10/2012
(Continued)

OTHER PUBLICATIONS

Chinese Office Action—Chinese Application No. 201880047054.X dated Feb. 22, 2021, citing KR 970003006, JP 2006035272, JP 2002346704, CN 109311084, CN 1172446, CN 1132483, DE 19922829, WO 2009/115601, JP S5868456, JP H03138052, JP 2002011555, CN 102728827, CN 103990786, CN 106513608, and JP H0550193.

(Continued)

*Primary Examiner* — Kevin E Yoon
(74) *Attorney, Agent, or Firm* — Cantor Colburn LLP

(57) ABSTRACT

Provided is a molten material treatment apparatus including: a container having an upper portion, on which a molten material injection part is disposed, and a bottom part in which a hole is formed; a gas injection part attached to the bottom part between the molten material injection part and the hole; a chamber part formed on the upper portion of the container so as to face the gas injection part and having an inside open downward; and a plurality of vertical members disposed so as to cross a plurality of positions of a rotary flow region formed between the chamber part and the bottom part, wherein an inclusion removal efficiency can be improved while maintaining the molten material surface by (Continued)

a method in which a plurality of mutually different rotary flows are generated in a plurality of sections within the rotary flow region and are partially overlapped.

10 Claims, 5 Drawing Sheets

(51) Int. Cl.
*B22D 1/00* (2006.01)
*B22D 41/00* (2006.01)

(56) References Cited

FOREIGN PATENT DOCUMENTS

| | | | | | |
|---|---|---|---|---|---|
| CN | 103990786 | | | 8/2014 | |
| CN | 106513608 | | | 3/2017 | |
| EP | 0230124 | | | 7/1987 | |
| JP | S58068456 | | | 4/1983 | |
| JP | S59107755 | | | 6/1984 | |
| JP | 61111749 | A | * | 5/1986 | ..... B22D 11/117 |
| JP | 62224464 | A | * | 10/1987 | ..... B22D 11/118 |
| JP | 03138052 | | | 6/1991 | |
| JP | H05050193 | | | 3/1993 | |
| JP | 07268437 | | | 10/1995 | |
| JP | H08215805 | | | 8/1996 | |
| JP | 09122848 | | | 5/1997 | |
| JP | 2002011555 | | | 1/2002 | |
| JP | 2002180124 | | | 6/2002 | |
| JP | 2002346704 | | | 12/2002 | |
| JP | 2006035272 | | | 2/2006 | |
| JP | 2006218534 | | | 8/2006 | |
| JP | 2010089152 | | | 4/2010 | |
| KR | 19950029710 | | | 11/1995 | |
| KR | 19970003006 | | | 4/1997 | |
| KR | 20000044839 | | | 7/2000 | |
| KR | 20090126625 | | | 12/2009 | |
| KR | 20140129895 | | | 11/2014 | |
| KR | 20150011243 | | | 1/2015 | |
| KR | 20170138860 | | | 12/2017 | |
| KR | 20180072459 | | | 6/2018 | |
| WO | 9506534 | | | 3/1995 | |
| WO | 0071283 | | | 11/2000 | |
| WO | 2009115601 | | | 9/2009 | |

OTHER PUBLICATIONS

Japanese Office Action—Japanese Application No. 2020-501541 dated Dec. 22, 2020, citing JP 2002-346704, JP 59-107755, JP 08-215805, and WO 00/71283.

European Search Report—European Application No. 18831807.5 dated May 29, 2020, citing KR 970003006, JP 2006035272, JP H03138052, JP 2002346704, WO 95/06534, and WO 2009/115601.

PCT Written Opinion—PCT/KR2018/007911 dated Oct. 1, 2018, citing KR 20-1997-0003006, JP 2006-035272 and JP 03-138052.

International Search Report—PCT/KR2018/007911 dated Oct. 1, 2018.

* cited by examiner

MOLTEN MATERIAL TREATMENT APPARATUS

CROSS-REFERENCE TO RELATED APPLICATIONS

This application is a national entry of PCT Application No. PCT/KR2018/007911 filed on Jul. 12, 2018, which claims priority to and the benefit of Korean Application No. 10-2017-0089782 filed on Jul. 14, 2017, in the Korean Patent Office, the entire contents of which are incorporated herein by reference.

TECHNICAL FIELD

The present disclosure relates to a molten material treatment apparatus, and more particularly, to a molten material treatment apparatus capable of improving inclusion removal efficiency while stably maintaining a molten material surface by using a method of generating mutually different rotary flows in a plurality of sections within a rotary flow region and partially overlapping the rotary flows.

BACKGROUND ART

In general, continuous casting equipment includes: a ladle for transporting a molten steel; a turndish for receiving the molten steel from the ladle and temporarily storing the molten steel; a mold for firstly solidifying the molten steel into a slab while continuously receiving the molten steel from the turndish; and a cooling platform for performing a series of shaping operations while secondly cooling the slab continuously drawn from the mold.

In the molten steel, inclusions are subjected to floatation in the turndish, slag is stabilized, and reoxidation is prevented. Subsequently, an initial solidified layer is formed on the molten steel in a mold in a slab shape, and at this point, the surface quality of the slab is determined. When the surface quality of the slab is determined, the cleanliness of the molten steel against inclusions has great influence. When the cleanliness of the molten steel against inclusions is undesirable, the surface quality of the slab is degraded by an abnormal flow of the molten steel caused by inclusions inside the mold. In addition, inclusions by themselves cause surface defects of the slab.

The cleanliness of the molten steel against inclusions is determined at the turndish. For example, while the molten steel stays in the turndish, the inclusions inside the molten steel is floated due to a difference in specific weights of the molten steel and the inclusions, and according to the extent of floatation of inclusions while the molten steel stays in the turndish, the cleanliness of the molten steel against the inclusions greatly varies. That is, the longer the staying time of the molten steel inside the turndish, the more the extent of floatation of the inclusions inside the molten steel and the cleanliness of the molten steel against inclusions is remarkably improved.

Thus, in related arts, a dam and a weir were installed to the turndish, and by using these, the flow of the molten steel was delayed and the staying time of the molten steel inside the turndish was increased. However, when the inclusions have sizes no greater than 30 μm, the staying time of the molten steel required to floatation of the inclusions inside the turndish is longer than the time from the overflow of the molten steel over the dam and the weir to the discharge from the turndish. Therefore, in related arts, it was difficult to remove fine inclusions from a molten steel inside the turndish.

RELATED ART DOCUMENTS

Patent Documents (Patent document 1) KR10-2000-0044839 A

DISCLOSURE OF THE INVENTION

Technical Problem

The present disclosure provides a molten material treatment apparatus capable of generating mutually different rotary flows in a plurality of sections within a rotary flow region and partially overlapping the rotary flows.

Technical Solution

In accordance with an exemplary embodiment, a molten material treatment apparatus includes: a container having an upper portion, on which a molten material injection part is disposed, and a bottom part in which a hole is formed; a gas injection part attached to the bottom part between the molten material injection part and the hole; a chamber part formed on the upper portion of the container so as to face the gas injection part and having an inside open downward; and a plurality of vertical members disposed so as to cross a plurality of positions of a rotary flow region formed between the chamber part and the bottom part.

The gas injection part may be attached to the bottom part so as to be positioned between at least any two of the vertical members.

The gas injection part may be positioned between any two mutually adjacent vertical members.

The respective vertical members may be disposed respectively crossing three or more positions of the rotary flow region, and the gas injection part may be positioned so as to face the vertical member in the middle among any three mutually adjacent vertical members.

The gas injection part may be provided in plurality and the plurality of gas injection members may be spaced apart from each other, and the gas respective injection parts may be spaced apart from each other with at least two vertical members among the plurality of vertical members interposed therebetween.

The respective vertical members may be disposed respectively crossing three or more positions of the rotary flow region, and at least any one of the plurality of gas injection parts may be positioned between at least any two mutually adjacent vertical members.

The respective vertical members may be disposed respectively crossing three or more positions of the respective rotary flow region, and at least any one of the plurality of gas injection parts may be positioned so as to face any one vertical member among the plurality of vertical members.

The plurality of vertical members may respectively cross a plurality of positions, spaced apart from each other in a direction from the molten material injection part toward the hole, in a direction crossing the direction from the molten material injection part toward the hole.

The plurality of vertical members may be installed such that respective lower ends thereof are spaced apart from the bottom part and respective upper ends thereof are immersible into the molten material injected into the container.

The chamber part may include a plurality of wall body parts spaced apart from each other to both sides with the gas injection part therebetween, and the rotary flow region may be defined by region lines extending downward from the plurality of respective wall parts and connected to the bottom part.

The chamber part may include: a lead member formed on the upper portion of the container so as to face the gas injection part; a first wall body extending downward from a molten material injection-side end portion of the lead member; and a second wall body extending downward from a hole-side end portion of the lead member.

The first wall body may be positioned between the molten material injection part and the gas injection part, the second wall body may be positioned between the gas injection part and the hole, and the plurality of vertical members may be positioned between the first wall body and the second wall body.

Each of the first wall body and the second wall body may have a lower end extending to a height immersible into the molten material injected into the container.

The molten material treatment apparatus may include a dam member formed between the gas injection part and the hole along a boundary of the rotary flow region so as to cross a lower portion of the container.

The dam member may have a lower end contacting the bottom part and an upper end formed in a height separable downward from the chamber part.

Advantageous Effects

In accordance with exemplary embodiments, a plurality of mutually different rotary flows may be generated and overlapped in rotary flow regions inside a container for treating molten material, and in both cases in which the gas blowing amounts are maintained or increased, the inclusion removal efficiency may be improved while stably maintaining the molten material surface. That is, the inclusion removal efficiency may be improved while stably maintaining the molten material surface without increasing the gas blowing amount, and even when the gas blowing amount is increased, the inclusion removal efficiency may be improved while stably maintaining the molten material surface.

More specifically, a rotary flow region is provided in the container by installing a gas injection part on the bottom part of the container and installing a chamber part on the container so that the chamber part faces the gas injection part, mutually different rotary flows are generated in each of a plurality of sections within the rotary flow region, and then, the mutually adjacent rotary flows at the boundaries of the respective sections may be overlapped. Accordingly, a plurality of rotary flows may be generated while maintaining the same gas blowing amount without increasing the gas blowing amount, and thus, the inclusion removal efficiency may be improved by increasing the amount of rotation of the molten material while stably maintaining the molten material surface.

In addition, a plurality of rotary flows may be generated by increasing the gas blowing amount, and in this case, even when a portion of slag is mixed into the molten material while a strong shear stress is applied to the slag floating on the molten material surface of the molten material, the slag mixed into the molten material is collected or floated to positions where the rotary flows overlap, and thus, the inclusion removal efficiency may be improved while stably maintaining slag on the molten material surface even when the gas blowing amount is increased.

MODE FOR CARRYING OUT THE INVENTION

Figure 1:
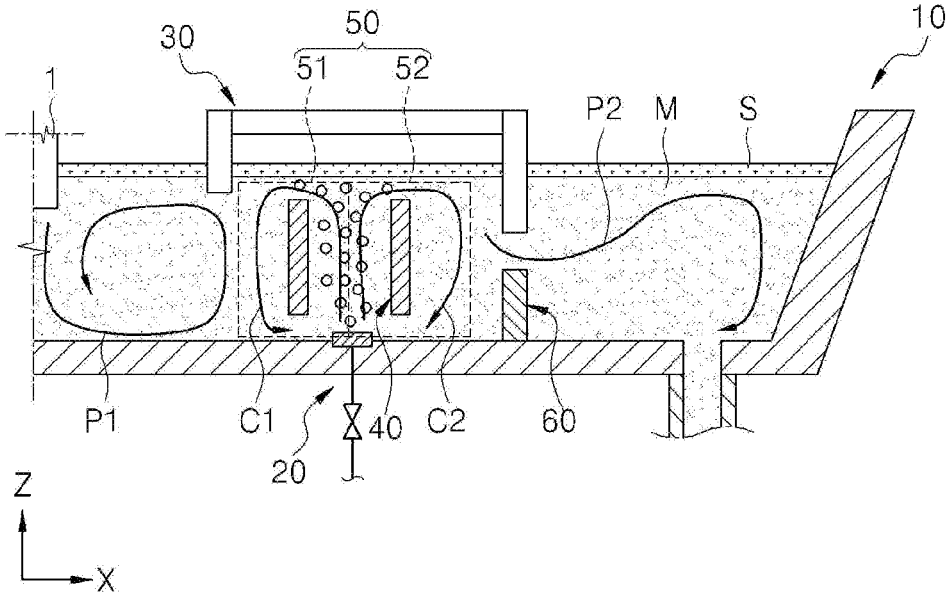
FIG. 1 is a schematic view of a molten material treatment apparatus in accordance with an exemplary embodiment.

Hereinafter, embodiments of the present invention will be described in detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the inventive concept to those skilled in the art. To describe exemplary embodiments, drawings may be exaggerated and like reference numerals denote like elements in the drawings.

The present disclosure relates to a molten material treatment apparatus capable of intensively generating mutually different rotary flows while locally generating rotary flow inside a container for treating molten material, thereby improving inclusion removal efficiency. Exemplary embodiments will be described with respect to a continuous casting process in a steel mill. Of course, the present disclosure may be variously applied to equipment and processes for treating various molten material in several industrial fields.

Figure 2:
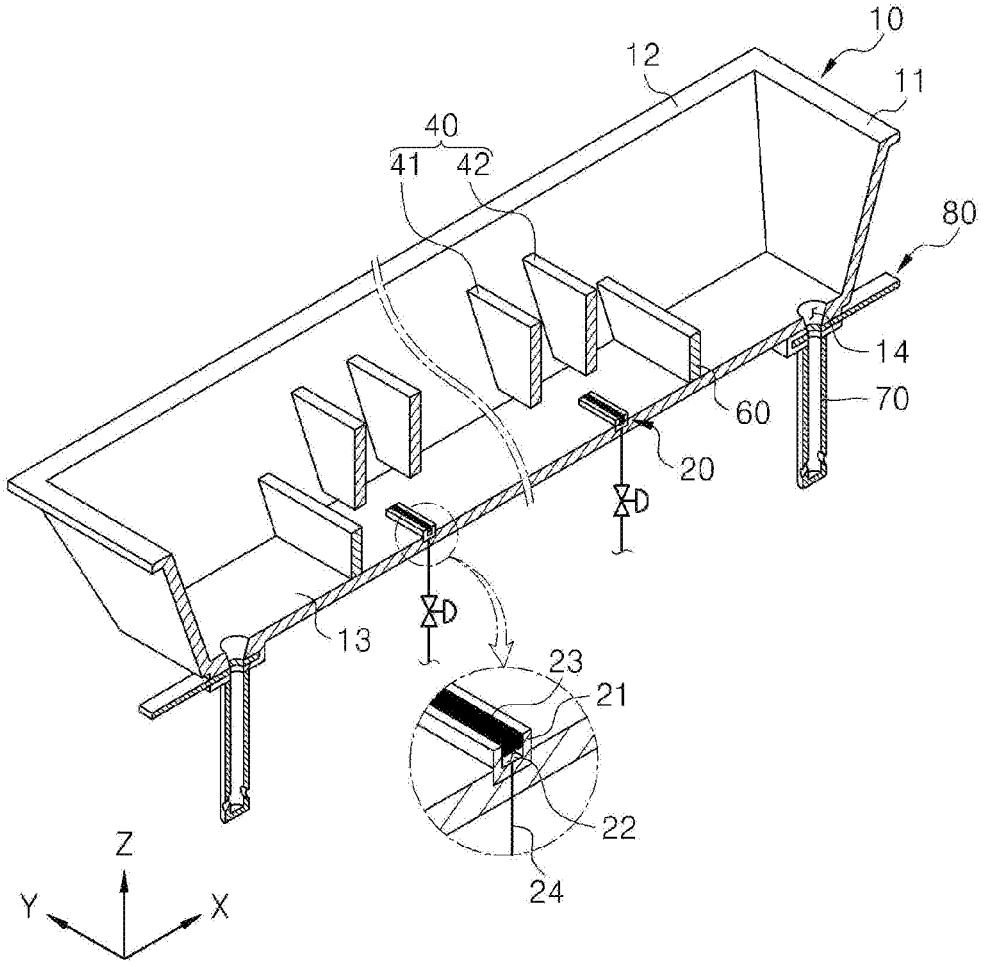
FIG. 2 is a schematic view of a molten material treatment apparatus in accordance with an exemplary embodiment.

FIG. 1 is a schematic view illustrating a portion cut in the width direction around the center of a molten material treatment apparatus in accordance with an exemplary embodiment, and FIG. 2 is a schematic view illustrating a portion cut in the lengthwise direction around the center of a molten material treatment apparatus in accordance with an exemplary embodiment. In addition, FIG. 3 is a schematic view of a chamber part in accordance with an exemplary embodiment.

Figure 3:
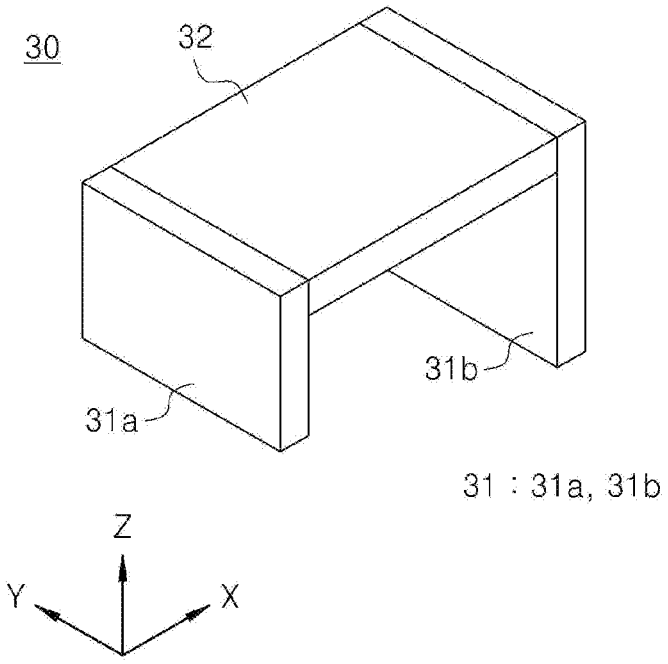
FIG. 3 is a schematic view of a chamber part in accordance with an exemplary embodiment.

Referring to FIGS. 1 to 3, a molten material treatment apparatus in accordance with an exemplary embodiment will be described in detail. The molten material treatment apparatus includes: a container 10 having an upper portion, on which a molten material injection part 1 is disposed, and a bottom part 13 in which a hole 14 is formed; a gas injection part 20 attached to a bottom part 13 between the molten material injection part 1 and the hole 14; a chamber part 30 formed on an upper portion of the container 10 so as to face the gas injection part 20 and having the inside open downward; and a plurality of vertical members 40 respectively disposed so as to cross a plurality of positions in a rotary flow region 50 formed between the chamber part 30 and the bottom part 13.

The molten material M may include molten steel completely refined in steel-making equipment. Of course, the molten material may be diversified. The molten material M may be provided to be contained in a transportation container, for example, a ladle. The transportation container may be transported to the upper side of the container 10 and positioned on the molten material injection part 1. When performing a refining process in steel-making equipment, additives such as aluminum or silicon used in deoxidation or the like of the molten material M are mostly removed by reacting with oxygen inside the molten material M, but inclusions (fine inclusions) having very small sizes may be remained as it is in the molten material M and be mixed with the molten material M in the container 10.

Accordingly, in an exemplary embodiment, the rotary flow region is formed inside the molten material M using the gas injection part 20 and the chamber part 30, a plurality of mutually different rotary flows are intensively generated inside the rotary flow region using a plurality of vertical members 40 and partially overlap with each other, and by using these, fine inclusions may be effectively removed.

The molten material injection part 1 is a hollow refractory nozzle through which the molten material M that can pass and may include a shroud nozzle. The molten material injection part 1 may be supported by being attached to, for example, a manipulator, and may be coupled to and communicate with a collector nozzle of a transportation container by the rise of the manipulator (not shown).

Meanwhile, an exemplary embodiment will be described below using a lengthwise direction X, a width direction Y, and a height direction Z. The lengthwise direction X is the direction from the molten material injection part 1 to the hole 14, and the width direction Y is the direction crossing the direction from the molten material injection part 1 to the hole 14. The height direction Z may be an up-down direction or the vertical direction. The abovementioned directions are for understanding the exemplary embodiment, and are not for limiting the present disclosure.

The molten material injection part 1 may be spaced apart from the bottom part 13 of the container 10 and be aligned in the height direction Z at the center of the bottom part 13. The molten material injection part 1 may inject the molten material M into the container 10. While injecting the molten material M, a lower portion of the molten material injection part 1 may be immersed in the molten material M while the level of the molten material M rises.

The container 10 may include: a bottom part 13 extending in the lengthwise direction X and the width direction Y; a pair of widthwise side wall parts 11 protruding upward on both widthwise end portions of the bottom part 13; and a pair of lengthwise side wall parts 12 protruding upward on both lengthwise end portions of the bottom part 13. A predetermined-shape space open upward may be formed inside the container 10 by the bottom part 13, the widthwise side wall parts 11, and the lengthwise side wall parts 12.

The widthwise side wall parts 11 may extend in the width direction Y and be disposed apart from each other in the lengthwise direction X so as to face each other, and the lengthwise side wall parts 12 may extend in the lengthwise direction X and be disposed to be spaced apart from each other in the width direction Y so as to face each other.

The container 10 may have an outer surface formed of an iron skin and have an inner surface on which refractory may be built. The container 10 may include a turndish of, for example, continuous casting equipment.

The container 10 has a rectangular shape which is left-right symmetrical with respect to the centers thereof in the lengthwise direction X and the width direction Y, and the width in the lengthwise direction X may be larger than the width in the width direction Y. The container 10 has the molten material injection part 1 disposed on the upper portion thereof, and the molten material injection part 1 is disposed so as to be aligned in the height direction Z at the centers in the lengthwise direction X and the width direction Y of the container 10.

The hole 14 may be formed at each of predetermined positions which are spaced apart from each other on the bottom part 13 in the lengthwise direction X with the molten material injection part 1 therebetween. The hole 14 may pass through the bottom part 13 in the vicinity of the widthwise side walls 11 and be formed in the vicinity of the respective lengthwise end portions in the bottom part 13. The hole 14 may be left-right symmetrical about the centers in the lengthwise direction X and the width direction Y. The molten material M inside the container 10 may be discharged through the hole 14. A gate 80 may be disposed to the hole 14.

Meanwhile, in the exemplary embodiment, the molten material treatment apparatus has a left-right symmetrical structure, and FIGS. 1 and 3 are views corresponding to the right side of the molten material treatment apparatus. Hereinafter, unless the left and right sides of the molten material treatment apparatus are not particularly discriminated, the exemplary embodiment is described with respect to the right side of the molten material treatment apparatus, and the technical feature described in this case may be identically applied to the left side of the molten material treatment apparatus.

The gas injection part 20 may be attached to the bottom part 13 between the molten material injection part 1 and the hole 14. The gas injection part 20 may include: a gas injection part main body 21 which extend in the width direction Y and installed so as to be spaced apart from each other to the hole 14 side; a gas injection port 22 formed to be recessed on the upper surface of the gas injection part main body 21; a porous part 23 attached to cover the upper portion of the gas injection port 22 and having an upper surface exposed to the inside of the container 10; and a gas injection pipe 24 attached to pass through the bottom part 13 and the gas injection part main boy 21 so as to communicate with the gas injection port 22.

The gas injection part main body 21 may have a rectangular block shape and include a dense refractory material. The gas injection port 22 may extend in the width direction Y along the upper surface of the gas injection part main body 21 and be formed to be recessed. The porous part 23 is attached to cover the upper portion of the gas injection port 22, and the porous part 23 may have a porous refractory material. The gas may include an inert gas and the inert gas may include, for example, an argon gas. The gas flows into the lower portion of each gas injection port 22 through the gas injection pipe 24, passes through the porous part 23, and be sprayed into the molten material M inside the container 10 in a state of fine bubbles.

An Upward flow of the molten material M is formed over of the gas injection part 20 by the gas injected into the molten material M by the gas injection part 20. The upward flow is divided, on the upper surface of the molten material M, for example, in the vicinity of the molten material surface, into a lengthwise flow directing the molten material injection part 1 side and a lengthwise flow directing toward the hole 14 side. And Each of the lengthwise flows forms downward flow which direct to the bottom part 13 while contacting the below-described wall body part 31 of the chamber part 30.

The downward flows may each be recovered in the direction toward the gas injection part 20 near the bottom part 13 by a Ventura effect formed in the vicinity of the gas injection part 20. Accordingly, a plurality of mutually different rotary flows C1 and C2 may be formed between the gas injection part 20 and the chamber part 30. Hereinafter, when it is unnecessary to describe the plurality of mutually different rotary flows C1 and C2 in a specially discriminated manner, the plurality of mutually different rotary flows C1 and C2 are totally referred to as rotary flows. Meanwhile, the rotary flows may also be referred to as vertical rotary flows.

The molten material M may be rotated multiple times in a rotary flow region 50 inside the container 10 for a predetermined time which is enough for fine inclusions are float-separated by the rotary flows, and the fine inclusions are floated by the repeated rotation of the molten material M and collected and removed by slag S on the molten material surface, or collected and removed by gas in bubble state.

The chamber part 30 may be formed on an upper portion of the container 10 so as to face the gas injection part 20 in the vertical direction, and have the inside open downward so as to form the rotary flow regions 50 with the bottom part 13. The chamber part 30 functions to form the rotary flow regions 50 in which the plurality of mutually different rotary flows C1 and C2 are intensively formed inside the container 10.

To this end, the chamber part 30 may include a plurality of wall body parts 31 which are spaced apart from each other with the gas injection part 20 therebetween and have respective lower portions immersed into the molten material M. In addition, the rotary flow region 50 may be defined as a space, having the identical size to the predetermined shape inside the container 10 between the bottom part 13 and the chamber part 30, by region lines extending downward from the plurality of wall body parts 31 and respectively connected to the bottom part 13.

The chamber part 30 may include: a lead member 32 formed on an upper portion of the container 10 so as to face the gas injection part 20 and extending tin the lengthwise direction X and the width direction Y; and a plurality of wall body parts 31 extending downward from respective both end portions of the lead member 32. The plurality of wall body parts 31 may each include: a first wall body 31*a* extending downward from the molten material injection part-side end portion among the both widthwise end portions of the lead member 32; and a second wall body 31*b* extending downward from the hole-side end portion among the both widthwise end portions of the lead member 32. Here, the widthwise end portion means an end portion extending in the width direction Y. The end portions extending in the lengthwise direction X is referred to as lengthwise end portions. The chamber part 30 may also include a pair of flanges (not shown) which protrude from both the lengthwise end portions of the lead member 32 and connect the first wall body 31*a* and the second wall body 31*b* in the lengthwise direction. The pair of flanges may each have a groove recessed upward on the lower portion thereof, and a plurality of vertical members 40 may be disposed in the groove so as to prevent collision with the pair of flanges.

The chamber part 30 may be installed by connecting the mutually facing surfaces of the lengthwise wall bodies 12 of the container 10, or be installed so as to be spaced apart from the mutually facing surfaces of the lengthwise wall bodies 12 of the container 10.

The lead member 32 is a plate-shaped member and may be formed in a predetermined area so as to form the upper surface of the chamber part 30. The lead member 32 may each be installed at a height that can be spaced apart upward from the plurality of vertical members 40, and at this point, may also be installed at a height that can be spaced apart from the molten material M inside container 10. Of course, the lead member 32 may be immersed in the molten material M according to the level of the upper surface of the molten material M. When the lead member 32 is spaced apart from the molten material surface, a predetermined space is generated, and this space may be protected by the lead member 32, the wall body part 31 and the plurality of flanges, and may be controlled in a vacuum atmosphere or in an inert gas atmosphere by the gas escaped from the upper surface of the molten material M. Accordingly, even when naked molten material surfaces are formed in the chamber part 30, the naked molten material surface may be prevented from contact with atmospheric air.

The first wall body 31*a* may be positioned between the molten material injection part 1 and the gas injection part 20. The first wall body 31*a* may extend in the width direction Y and the height direction Z and protrude downward from the molten material injection part-side end portion of the lead member 32. At this point, the molten material injection part-side end portion means the end portion facing the molten material injection part 1. The second wall body 31*b* may be positioned between the gas injection part 20 and hole 14. The second wall body 31*b* may extend in the width direction Y and the height direction Z and protrude downward from the hole-side end portion of the lead member 32. At this point, the hole-side end portion means the end portion facing the hole 14. Meanwhile, the second wall body 31*b* may be installed so as to vertically face a below-described dam member 60. The plurality of vertical members 40 may be positioned between the first wall body 31*a* and the second wall body 31*b*.

The first wall body 31*a* and the second wall body 31*b* may extend to a height such that the respective lower ends thereof can be immersed into the molten material injected into the container 10 and be spaced apart from the bottom part 13. At this point, the second wall body 31*b* may extend to a height that can be spaced apart from the dam member 60.

The first wall body 31*a* and the second wall body 31*b* may guide, near the molten material surface, a lengthwise flow toward the molten material injection part 1 side and a lengthwise flow toward the hole 14 side into respective downward flows toward the bottom part 13. The downward flows may each be recovered in the direction toward the gas injection part 20 by a Venturi effect near the bottom part 13, and be joined to an upward flow, and thus, a rotary flow may be formed. That is, the wall body part 31 serves an important role in formation of the rotary flow.

Meanwhile, the second wall body 31*b* may be spaced apart from the dam member 60 while facing the dam member 60, and the flow rate of the rotary flow and the flow rate of a below-described hole-side flow P2 may be relatively determined according to the spacing distance between the second wall body 31*b* and the dam member 60. At this point, the spacing distance between the second wall body 30*b* and the dam member 60 is inversely proportional to the flow rate of the rotary flow. For example, the closer the second wall body 31*b* to the dam member 60, the smaller the flow rate of the hole-side flow P2, and the larger the flow rate of the rotary flow may be, and conversely, the farther the second wall body 31*b* to the dam member 60, the larger the flow rate of the hole-side flow P2, and the smaller the flow rate of the rotary flow may be. Flows each have relationship that the larger the flow rate thereof, the larger the rotation speed thereof.

The plurality of vertical members 40 may be positioned in the rotary flow region 50 surrounded by the first wall body 31*a*, the second wall body 31*b*, the lead member 32, and the bottom part 13. At this point, the plurality of vertical members 40 may be disposed so as to connect the pair of lengthwise side wall parts 12 by crossing, in the width direction Y, a plurality of positions inside the rotary flow region 50 mutually spaced apart in the lengthwise direction X such that mutually different rotary flows are generated in a plurality of sections inside the rotary flow region 50.

In addition, the plurality of vertical members 40 may extend in the height direction Z and be installed at the height such that the respective lower ends thereof may be spaced apart from the bottom part 13, and the respective upper ends thereof may be immersed in the molten material M injected into the container 10. At this point, the plurality of vertical members 40 may each be built with refractory, and include a weir.

When the molten material M is received in the container 10 and a desired molten material surface level is formed, the flow of the molten material M may be controlled while the plurality of vertical members 40 are immersed in the molten material M. In particular, when the molten material M is received in the container 10 and a desired molten material surface level is formed, the vertical members 40 act as the center of the respective rotary flows, and the rotary flows may stably maintained.

For example, the plurality of vertical members 40 function to guide the rotary flows when the molten material injection part-side flow P1 of the molten material M injected into the container 10 through the molten material injection part 1 forms a rotary flow while guided to an upper portion of the container 10 above the gas injection part 20. In addition, the plurality of vertical members 40 function to generate and maintain the rotary flow by imparting Venturi effects between the gas injection part 20 and the vertical members 40.

That is, when the chamber part 30 forms the rotary region 50 above the gas injection part 20, the plurality of vertical members 40 function as cores of the respective rotary flows so as to form mutually different rotary flows inside the rotary flow region 50. At this point, according to the number of the vertical members 40, the number of the gas injection part 20, and the arrangement relationship therebetween, the states of the rotary flows, such as the number of the rotary flows inside the rotary flow region 50 and the rotary directions of the respective rotary flows, are variously determined. Among these, the states of the rotary flows inside the rotary flow region 50 may be roughly classified on the basis of the number of the gas injection part 20, and the states of the rotary flows inside the rotary flow region 50 may be more finely classified on the basis of the number of the vertical members 40 and the position of the gas injection part 20.

First, when the number of the gas injection part 20 is one, and the number of the plurality of vertical members 40 is two, the vertical members may be disposed respectively crossing the two positions of the rotary flow region 50, and the gas injection part 20 may be positioned between the two adjacent vertical members 40.

In addition, when the number of the gas injection part 20 is one, and the number of the plurality of vertical members 40 is three or more, the vertical members may be disposed respectively crossing the three or more positions of the rotary flow region 50, and the gas injection part 20 may be attached to the bottom part 13 so as to be positioned at least between any two adjacent vertical members 40. At this point, the gas injection part 20 may be positioned between two adjacent vertical members or be positioned so as to face a middle vertical member among any three vertical members.

In all these cases, provided is a structure in which a plurality of rotary flows, for example, two rotary flows can be formed by using a single gas injection part 20. That is, since the structure is provided in which a plurality of sections, for example, two or three sections are provided in the rotary flow region 50 without an increase in a gas blowing amount, the inclusion removal effect may be enhanced.

At this point, when the gas injection part 20 is positioned between the two adjacent vertical members 40, a plurality of rotary flows may be generated so as to be adjacent to each other and be caused to overlap each other, and thus, the inclusion removal efficiency may be enhanced without increasing the gas blowing amount.

In other words, since the molten material M may overlap each other while forming rotary flows in several different directions at a plurality of positions within the rotary region 50, the amount of rotation of the molten material M may be maximized even without intensively and strongly rotating the molten material M by increasing the blowing amount of gas. Thus, the molten material M may be rotated for a sufficient time before the molten material M escapes the rotary flow region 50 and the inclusion removal capability may be remarkably be improved.

Meanwhile, when the gas injection part 20 is positioned to face a vertical member in the middle among any three vertical members adjacent to each other, the gas is divided to both side at the vertical member in the middle and the half of the gas blowing amount may be assigned to each of the rotary flows, and accordingly, an unnecessary increase in the strength of the rotary flows is prevented and the generation of a naked molten material on the molten material surface may be suppressed or prevented.

In other words, even though increasing the gas blowing amount, the amount can be assigned to each rotary flow, and thus, the molten material surface may stably be maintained by preventing an excessive increase in the strength of the rotary flow. Of course, the molten material M may be rotated for a sufficient time before the molten material M escapes the rotary flow region 50, and thus, the inclusion removal capability may be remarkably be improved, that is, the inclusion removal efficiency may be improved.

Meanwhile, when both the number of gas injection part 20 and the number of the plurality of vertical members 40 are two, the gas injection parts 20 may be spaced apart from each other with the two respective vertical members 40 therebetween.

In addition, when a plurality of, for example, two or more gas injection parts 20 are provided and spaced apart from each other, and a plurality of, for example, three or more vertical members 40 are provided and space apart from each other, the vertical members may each be disposed crossing the three or more positions of the rotary flow regions 50, and the gas injection parts 20 may be spaced apart from each other with at least any two vertical members among the plurality of vertical members 40. At this point, at least any one of the plurality of gas injection parts 20 may be positioned between any two vertical members adjacent to each other. Alternatively, at least any one of the plurality of gas injection parts 20 may be positioned facing any one vertical member among the plurality of vertical members 40.

In these cases, provided is a structure in which a plurality of, for example, two or more mutually different rotary flows may be generated and overlap by using the plurality of gas injection parts 20. At this point, the total amount of the gas injected into the molten material M increases, but the gas blowing amount and the increase in the gas blowing amount are evenly distributed to each of the plurality of mutually different rotary flows, and thus, the amount of rotation of the molten material M may remarkably increased while the molten material surface can be more stably maintained by preventing unnecessary increase in the strength of the rotary flows. Thus, the molten material M may be rotated for a sufficient time before the molten material M escapes the rotary flow regions 50 and the inclusion removal capability may be remarkably be improved.

In addition, as the shear stress applied to slag due to an increase in the strength of the rotary flows, the slag mixed into the molten material M is collected to a place where the plurality of rotary flows overlap, and is caused to stay within the rotary flow region 50 even if the slag is pushed and mixed into the molten material M, and thus, the possibility of floatation of the slag may be enhanced. That is, the slag mixed into the molten material M may be floated to the molten material surface after being guided to the place where the rotary flows within the rotary flow region 50 before escaping the rotary flow region 50, and thus, a slag mixing problem may be suppressed or prevented, and the cleanliness of the molten steel may be improved.

In an exemplary embodiment, the present disclosure will be described on the basis of a case in which the number of the gas injection part 20 is one, the number of the vertical members 40 is two, and the two vertical members 40 are spaced apart from each other in the lengthwise direction X with the gas injection part 20 therebetween.

Referring to FIGS. 1 to 3, the plurality of vertical members 40 may include a first vertical member 41 and a second vertical member 42. At this point, the vertical member close to the molten material injection part 1 is the first vertical member 41, and the remainder is the second vertical member 42. The single gas injection part 20 may be positioned between the first vertical member 41 and the second vertical member 42. Due to this structure, the rotary flow region 50 may be divided into a first rotary flow section 51 and a second rotary flow region 52.

An upward flow generated between the first vertical member 41 and the second vertical member 42 is divided on the molten material surface to both sides in the lengthwise direction X, and the first rotary flow C1 and the second rotary flow C2 may be generated while a downward flow generated between the first vertical member 41 and the first wall body 31*a*, and a downward flow generated between the second vertical member 42 and the second wall body 31*b* are recovered between the first vertical member 41 and the second vertical member 42. The molten material M flows along the rotary flows, and may be joined to each of the rotary flows at the boundary between the first rotary flow section 51 and the second rotary flow section 52. For example, even when a portion of the molten material M within the rotary flow region 50 moves in the direction toward the hole 14 side, the molten material M may be rotated by the second rotary flow C2, and thus, the stay time of the molten material M and the contact time with the gas may be increased.

The molten material treatment apparatus may further include a dam member 60. The dam member 60 may be formed in the width direction Y so as to cross a lower portion of the container 10 along the boundary of the rotary flow region 50 between the gas injection part 1 and the hole 14. The dam member 60 is installed on the bottom part 13 so as to face the second wall body 31*b*, the lower end thereof contacts the bottom part, the upper end thereof is formed at a height spaced apart from the lower side of the second wall body 31*b*, and the dam member 60 may be installed so as to connect the pair of lengthwise side wall parts 12. A remaining molten material hole (not shown) may also be provided under the dam member 60.

The dam member 60 may divide and guide the downward flow toward the bottom part 13 along the second wall body 31*b* of the chamber part 30 into a main flow and a branch flow. First, the branch flow of the downward flow is a flow branching so as to face the bottom part 13 along the second wall body 31*b* and then face the hole 14 side. The branch flow of the downward flow may pass through the rotary flow region 50 through a separation space between the second wall body 31*b* and the dam member 60, and then form a hole-side flow P2 directing the hole 14 side. The main flow of the downward flow is a flow which does not branch to the hole 14 side in the vicinity of the dam member 60 and continuously moves downward within the rotary flow region 50 while maintaining the downward flow. The downward flow may be recovered in the direction toward the gas injection part 20 by a Ventura effect near the bottom part 13, and be joined to an upward flow, and thus, a rotary flow may be formed.

Meanwhile, even if there is no dam member 60, the downward flow may be divided in the vicinity of the bottom part 13 in a direction toward the hole 14 and a direction toward the gas injection part 20, and may then form the hole-side flow P2 and the rotary flow. That is, the rotary flow may be generated by using the gas injection part 20, the chamber part 30 and the plurality of vertical members 40 without the dam member 60. Of course, the rotary flow may be more easily generated when using the dam member 60.

The gate 80 may be attached to the lower surface of the container 10 so as to be capable of opening/closing the hole 14. The gate 80 may include a slide gate. A nozzle 70 may be attached to the gate 80. The nozzle 70 may communicate with the hole 14 by the opening/closing of the gate 80. The nozzle 70 may include a submerged entry nozzle.

The molten material M may remove fine inclusions while rotating for a sufficient time in the rotary flow region 50 and then be discharged through the hole 14, pass through the gate 80, flow into the nozzle 70, and be supplied to a mold (not shown) provided under the nozzle 70.

The mold may be a rectangular or square hollow block, and have the inside that may be vertically opened upward or downward. The molten material M supplied to the mold may be firstly solidified in a slab shape, pass through a cooling platform (not shown) provided under the mold, be secondly cooled, and be continuously casted into a slab, which is a semi-product.

Hereinafter, the numbers and the positions of the gas injection part 20 and the vertical members which impart various states of the rotary flows within the rotary flow region 50 will be described through various modified examples according to exemplary embodiments.

Figure 4:
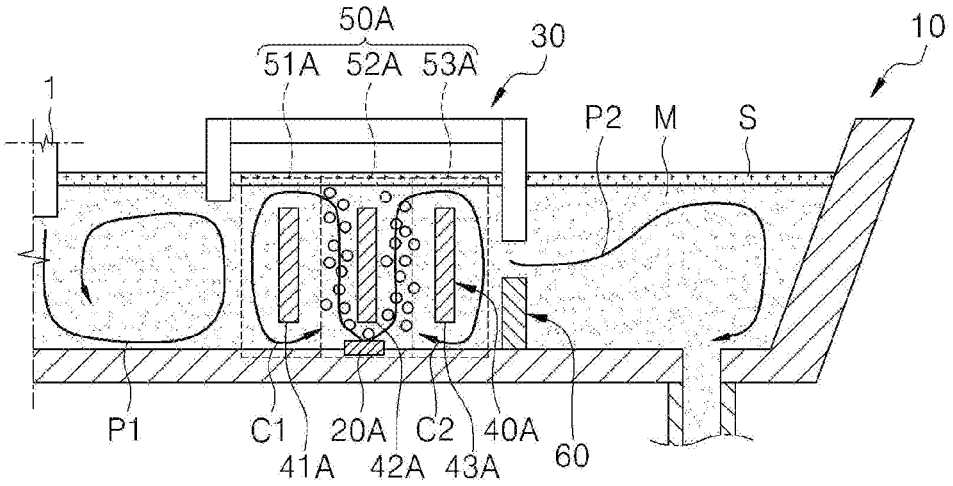
FIG. 4 is a schematic view of a molten material treatment apparatus in accordance with a first modified exemplary embodiment.
Figure 5:
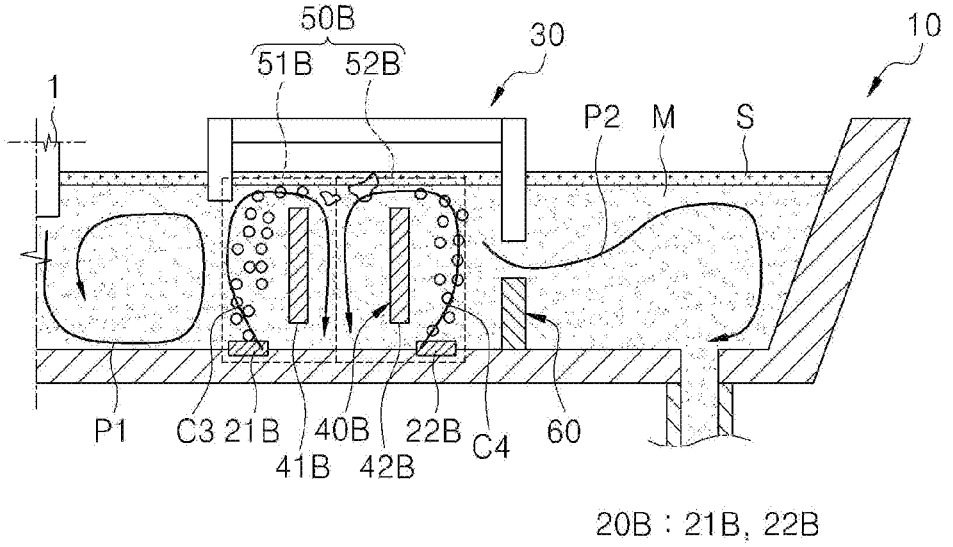
FIG. 5 is a schematic view of a molten material treatment apparatus in accordance with a second modified exemplary embodiment.
Figure 6:
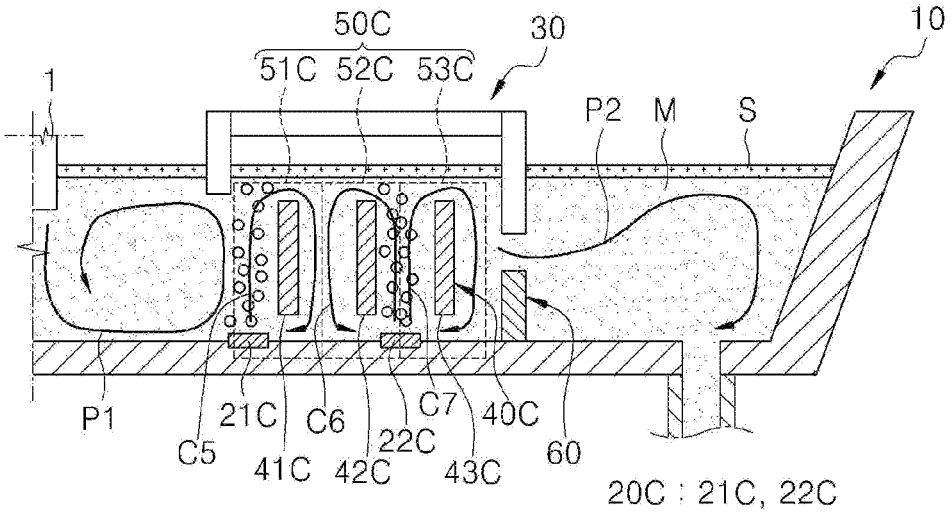
FIG. 6 is a schematic view of a molten material treatment apparatus in accordance with a third modified exemplary embodiment.
Figure 7:
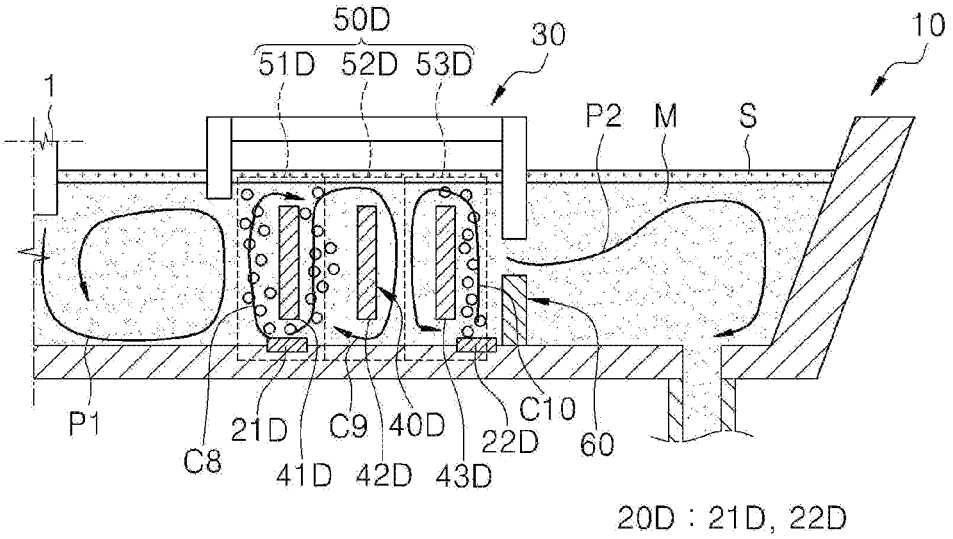
FIG. 7 is a schematic view of a molten material treatment apparatus in accordance with a fourth modified exemplary embodiment.

FIG. 4 is a schematic view of a molten material treatment apparatus in accordance with a first modified exemplary embodiment, FIG. 5 is a schematic view of a molten material treatment apparatus in accordance with a second modified exemplary embodiment, FIG. 6 is a schematic view of a molten material treatment apparatus in accordance with a third modified exemplary embodiment, and FIG. 7 is a schematic view of a molten material treatment apparatus in accordance with a fourth modified exemplary embodiment.

Referring to FIGS. 3 and 4, in the first modified exemplary embodiment, a plurality of vertical members 40A may include a first vertical member 41A, a second vertical member 42A, and a third vertical member 43A. At this point, the first vertical member 41A, the second vertical member 42A, and the third vertical member 43A may be disposed respectively crossing the three positions of a rotary flow region 50A, the first vertical member 41A may be positioned at the closest position to a molten material injection part 1, and the second vertical member 42A and the third vertical member 43A may be sequentially positioned at the subsequent positions. In this structure, the rotary flow region 50A may be divided into a first rotary flow section 51A, a connection section 52A, and a second rotary flow section 53A.

The gas injection part 20A may be positioned so as to face the second vertical member 42A among the three vertical members adjacent to each other. Gas is divided into both sides around the second vertical member 42A in the lengthwise direction X and two upward flows are generated, and while a downward flow generated between the first vertical member 41A and the first wall body 31*a*, and a downward flow generated between the third vertical member 43A and the second wall body 31*b* are recovered between the second vertical member 42A and the gas injection part 20A, a first rotary flow C1 and a second rotary flow C2 may be generated.

The molten material M is freely joined to each of the rotary flows under the connection section 52A while flowing each of the rotary flows. Even when a portion of the molten material M within the rotary flow region 50A moves in the direction toward the hole 14 side, the molten material may be rotated by the second rotary flow C2, and thus, the stay time of the molten material M and the contact time with the gas may be increased.

In addition, since the second vertical member 42A divides the gas, the generation of naked molten material on the molten material surface may be suppressed or prevented even when increasing the gas blowing amount by two times.

Referring to FIGS. 3 and 5, in accordance with the second modified exemplary embodiment, a plurality of vertical members 40B may include a first vertical member 41B and a second vertical member 42B, and each of the vertical members may be disposed crossing two positions of a rotary flow region 50B, and a first vertical member 41A may be positioned so as to be close to a molten material injection part 1. Here, the rotary flow region 50B may be divided into a first rotary flow section 51B and a second rotary flow region 52B.

A gas injection part 20B may include a first gas injection part 21B and a second gas injection part 22B. The gas injection parts 20B may be spaced apart from each other with the first vertical member 41B and the second vertical member 42B therebetween. At this point, the first gas injection part 21B may be positioned between the first wall body 31*a* and the first vertical member 41B, and the second gas injection part 22B may be positioned between the second vertical member 42B and the second wall body 31*b*.

An upward flow generated between the first wall body 31*a* and the first vertical member 41B, an upward flow generated between the second vertical member 42B and the second wall body 31*b*, and a downward flow generated between the first vertical member 41B and the second vertical member 42B by the plurality of gas injection parts 20B are linked with each other, a first rotary flow C3 and a second rotary flow C4 may overlap at the boundary between a first rotary flow section 51B and a second rotary flow section 53B while being strongly generated.

Even when a portion of the molten material M within the rotary flow region 50B moves in the direction toward the hole 14 side while flowing along each of the rotary flows, the molten material M may be rotated by the second rotary flow C4, and thus, the stay time of the molten material M and the contact time with the gas may be increased.

In addition, even when slag on the molten material surface is mixed into the molten material M, the mixing position is limited between the first vertical member 41B and the second vertical member 42B, and thus, flow in the direction toward the hole 14 side is prevented, and the slag may be float-separated while staying in the rotary flow region 50B.

Referring to FIGS. 3 and 6, in accordance with a third modified exemplary embodiment, a plurality of vertical members 40C may include a first vertical member 41C, a second vertical member 42C, and a third vertical member 43C, and each vertical member may be disposed crossing the three positions of a rotary flow region 50C, the first vertical member 41C may be positioned at the closest position to a molten material injection part 1, and the second vertical member 42C and the third vertical member 43C may be sequentially positioned at the subsequent positions.

A gas injection part 20C may include a first gas injection part 21C and a second gas injection part 22C. The first gas injection part 21C may be positioned between a first wall body 31*a* and the first vertical member 41C, and the second gas injection part 22C may be positioned between the second vertical member 42C and the third vertical member 43C. The rotary flow region 50C may be divided into a first rotary flow section 51C, a second rotary flow section 52C, and a third rotary flow section 53C.

An upward flow generated between the first wall body 31*a* and the first vertical member 41C overflows the upper portion of the first vertical member 41C by the gas injection part 20C in a direction from a molten material injection part 1 to a hole 14 by means of a downward flow generated between the first vertical member 41C and the second vertical member 42C, and a first rotary flow C5 is generated as a portion of the downward flow generated between the first vertical member 41C and the second vertical member 42C is recovered to the first gas injection part 21C side.

An upward flow generated between the second vertical member 42C and the third vertical member 43C is divided to both sides on the molten material surface in the lengthwise direction X, and while the downward flow generated between the first vertical member 41C and the second vertical member 42C, and the downward flow generated between the third vertical member 43C and the second wall body 31*b* are recovered between the second vertical member 42C and the third vertical member 43C, a second rotary flow C6 and a third rotary flow C7 may be generated.

As such, three mutually different rotary flows, which are sequentially generated in the direction from the molten material injection part 1 to the hole 14 and have rotary directions alternately varying in the order, and the three rotary flows may be overlapped at the boundaries between respective sections. That is, the three rotary flows may be generated by increasing one gas injection position, and thus, the formation of the rotary flows may be maximized. Accordingly, even when a portion of the molten material M within the rotary flow region 50C moves in the direction toward the hole 14 side, the molten material M may be rotated by the second rotary flow C6 and the third rotary flow C7, and thus, the stay time of the molten material M and the contact time with the gas may be increased.

Referring to FIGS. 3 and 7, in accordance with a fourth modified exemplary embodiment, a plurality of vertical members 40D may include a first vertical member 41D, a second vertical member 42D, and a third vertical member 43D, and each vertical member may be disposed crossing the three positions of a rotary flow region 50D, the first vertical member 41D may be positioned at the closest position to a molten material injection part 1, and the second vertical member 42D and the third vertical member 43D may be sequentially positioned at the subsequent positions.

A gas injection part 20D may include a first gas injection part 21D and a second gas injection part 22D. At this point, the first gas injection part 21D may be positioned under the first vertical member 41D so as to face the first vertical member 41D, and the second gas injection part 22D may be positioned between the third vertical member 43D and a second wall body 31*b*. The rotary flow region 50D may be divided into a first rotary flow section 51D, a second rotary flow section 52D and a third rotary flow section 53D.

The gas blown from the first gas injection part 21D branches to both sides of the first vertical member 41D and form upward flows, and the upward flow generated between the a wall body 31*a* and the first vertical member 41D among the upward flows overflows over the first vertical member 41D in the direction from the molten material injection part 1 to hole 14, is joined to the upward flow generated between the first vertical member 41D and the second vertical member 42D, and forms a first rotary flow branch flow C8, and a portion of downward flow generated by a plurality of gas injection parts 20D between the second vertical member 42D and the third vertical member 43D is recovered to the first gas injection part 21D side in the vicinity of a bottom part 13 and forms a first rotary flow main flow C9.

The upward flow generated between the first wall body 31*a* and the third vertical member 43D and the downward flow generated by the plurality of gas injection parts 20D between the second vertical member 42D and the third vertical member 43D are linked to each other, generate a second rotary flow C10, and may overlap each other at the boundary between a second rotary flow section 52D and a third rotary flow section 53D.

As such, three mutually different flows may be generated and overlapped at the boundaries between respective sections with mutually different methods. That is, the three rotary flows may be generated by increasing one gas injection position, and thus, the formation of the rotary flows may be maximized. Accordingly, even when a portion of the molten material M within the rotary flow region 50D moves in the direction toward the hole 14 side, the molten material M may be rotated by the first rotary flow main flow C8 and the second rotary flow C10, and thus, the stay time of the molten material M and the contact time with the gas may be increased.

When the molten material treatment apparatus in accordance with exemplary embodiments and modified exemplary embodiments thereof, which are formed as described above, are applied to a turndish of continuous casting equipment, a plurality of mutually different rotary flows are locally and intensively generated inside the turndish while performing a continuous casting process, and a portion of the rotary flows may be overlapped. Thus, the molten steel may be caused to stay for a long time while being repeatedly rotated a plurality of times inside the turndish, and the molten steel may be brought into contact with an argon gas in a bubble state. Accordingly, inclusions inside the molten steel may be effectively removed, and in particular, fine inclusions having the size smaller than 30 μm may effectively be removed.

At this point, slag on the molten material surface may be stably maintained by generating a plurality of mutually different rotary flows without increasing the gas blowing amount, and even when the plurality of rotary flows are generated by increasing the gas blowing amount, the slag mixed into the molten steel is collected or floated to positions at which the rotary flows overlap by using the overlap of the rotary flows, and thus, the slag on the molten material surface may stably be maintained.

That is, a rotary flow region is provided by installing the gas injection part 20 on the turndish bottom part, and the chamber part 30 on the turndish so that the chamber part vertically faces the gas injection part 20, and a plurality of vertical members 40 are installed. Subsequently, while receiving molten steel in the turndish and performing a continuous casting process, an argon gas is injected through the gas injection part 20, and thus, rotary flows may be generated. At this point, while generating a plurality of mutually different rotary flows centered around each of the vertical members 40 in mutually different sections, the rotary flows adjacent to each other may be overlapped at the boundaries between the mutually adjacent sections.

At this point, the gas injection part 20 is installed so as to face any one among the plurality of vertical members 40 or the gas injection part 20 is installed between the plurality of vertical members 40, so that a plurality of rotary flows may be generated while the same gas blowing amount is maintained without increasing the gas blowing amount, and thus, the inclusion removal efficiency may be improved while stably maintaining molten material surface.

In addition, a plurality of rotary flows may be generated by installing the plurality of gas injection parts 20 to be spaced apart from each other with at least any two mutually adjacent vertical members 40 interposed therebetween, and at this point, since rotary flows neighboring each other overlap, even when a portion of slag is mixed into the molten steel, the slag may be collected to positions where the rotary flows overlap and be floated, and the inclusion removal efficiency may be improved while maintaining slag on the molten material surface.

As such, in accordance with exemplary embodiments, the inclusion removal efficiency may be maximized by intensively forming a plurality of mutually different rotary flows inside a container 10.

For example, the inclusion removal efficiency may be enhanced by increasing the strength of rotary flows by a method of simply increasing the blowing amount of gas blown into a molten material M through gas injection parts 20, but in this method, since a strong rotary flow is generated in one direction while blowing a gas intensively to one point, a problem may be caused in which slag is mixed into the molten material M due to unstable flow of the molten material surface. Accordingly, there is a limit in simply increasing the gas blowing amount in order to enhance the inclusion removal efficiency.

Conversely, in exemplary embodiments, a method is used in which the inclusion removal efficiency is maximized by generating mutually different rotary flows in a plurality of respective sections, and thus, the inclusion removal effect may be enhanced without increasing the gas blowing amount.

In addition, in exemplary embodiments, even when increasing the gas blowing amount, the increased amount may be distributed to a plurality of mutually different rotary flows and suppress an increase in the strength of the rotary flows, and thus, the molten material surface may be further stably maintained.

In addition, as the shear stress applied to slag due to an increase in the strength of the rotary flows, the slag mixed into the molten material M is collected to a place where the plurality of rotary flows overlap, and is caused to stay within the rotary flow regions 50 even if the slag is pushed and mixed into the molten material M, and thus, the possibility of floatation of the slag may be enhanced. That is, the slag mixed into the molten material M may be floated to the molten material surface after being guided to the place where the rotary flows within the rotary flow region 50 before the slag escapes the rotary flow region 50, and thus, a slag mixing problem may be suppressed or prevented, and the cleanliness of the molten steel may be improved.

The above-mentioned exemplary embodiments are provided not to limit but to describe the present disclosure. The configuration and method disclosed in the above exemplary embodiments may be combined or shared with each other to be modified into various forms, and it should be noted that the modified embodiments belong to the scope of the present disclosure. That is, the present disclosure may be implemented various forms different from each other within the claims and technical ideas equivalent thereto, and those skilled in the art pertaining to the present disclosure could understand that various embodiments may be carried out within the scope of technical ideas of the present disclosure.

What is claimed is:

1. A molten material treatment apparatus comprising: a container having an upper portion, on which a molten material injection part is disposed, and a bottom part in which a hole is formed;

a gas injection part attached to the bottom part between the molten material injection part and the hole;

a chamber part formed on the upper portion of the container so as to face the gas injection part and having an inside open downward; and a plurality of vertical members disposed so as to cross a plurality of positions of a rotary flow region formed between the chamber part and the bottom part, wherein the gas injection part is attached to the bottom part so as to be positioned between at least any two of the vertical members, wherein the respective vertical members are disposed respectively crossing three or more positions of the respective rotary flow region, and the gas injection part is positioned so as to face the vertical member in the middle among any three mutually adjacent vertical members.

2. The molten material treatment apparatus of claim 1, wherein the plurality of vertical members respectively cross a plurality of positions, spaced apart from each other in a direction from the molten material injection part toward the hole, in a direction crossing the direction from the molten material injection part toward the hole.

3. The molten material treatment apparatus of claim 1, wherein the plurality of vertical members are installed such that respective lower ends thereof are spaced apart from the bottom part and respective upper ends thereof are immersible into the molten material injected into the container.

4. The molten material treatment apparatus of claim 1, wherein the chamber part comprises a plurality of wall body parts spaced apart from each other to both sides with the gas injection part therebetween, and the rotary flow region is defined by region lines extending downward from the plurality of respective wall parts and connected to the bottom part.

5. The molten material treatment apparatus of claim 1, wherein the chamber part comprises:

a lead member formed on the upper portion of the container so as to face the gas injection part;

a first wall body extending downward from a molten material injection-side end portion of the lead member; and a second wall body extending downward from a hole-side end portion of the lead member.

6. The molten material treatment apparatus of claim 5, wherein the first wall body is positioned between the molten material injection part and the gas injection part, the second wall body is positioned between the gas injection part and the hole, and the plurality of vertical members are positioned between the first wall body and the second wall body.

7. The molten material treatment apparatus of claim 5, wherein each of the first wall body and the second wall body has a lower end extending to a height immersible into the molten material injected into the container.

8. The molten material treatment apparatus of claim 1, comprising a dam member formed between the gas injection part and the hole along a boundary of the rotary flow region so as to cross a lower portion of the container.

9. The molten material treatment apparatus of claim 8, wherein the dam member has a lower end contacting the bottom part and an upper end formed in a height separable downward from the chamber part.

10. A molten material treatment apparatus comprising: a container having an upper portion, on which a molten material injection part is disposed, and a bottom part in which a hole is formed;

a gas injection part attached to the bottom part between the molten material injection part and the hole;

a chamber part formed on the upper portion of the container so as to face the gas injection part and having an inside open downward; and a plurality of vertical members disposed so as to cross a plurality of positions of a rotary flow region formed between the chamber part and the bottom part, wherein the gas injection part is provided in plurality and the plurality of gas injection parts are spaced apart from each other, and the respective gas injection parts are spaced apart from each other with at least two vertical members among the plurality of vertical members interposed therebetween, wherein the respective vertical members are disposed respectively crossing three or more positions of the respective rotary flow region, and at least any one of the plurality of gas injection parts is positioned so as to face any one vertical member among the plurality of vertical members.

* * * * *